US010744771B2

(12) United States Patent
Matsumoto et al.

(10) Patent No.: US 10,744,771 B2
(45) Date of Patent: Aug. 18, 2020

(54) METHOD OF MANUFACTURING LIQUID EJECTION HEAD AND METHOD OF MANUFACTURING STRUCTURE

(71) Applicant: CANON KABUSHIKI KAISHA, Tokyo (JP)

(72) Inventors: Keiji Matsumoto, Fukushima (JP); Seiichiro Yaginuma, Kawasaki (JP); Koji Sasaki, Nagareyama (JP); Jun Yamamuro, Yokohama (JP); Kunihito Uohashi, Yokohama (JP); Ryotaro Murakami, Yokohama (JP); Tomohiko Nakano, Fukushima (JP); Shingo Nagata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/117,182

(22) Filed: Aug. 30, 2018

(65) Prior Publication Data

US 2019/0070854 A1 Mar. 7, 2019

(30) Foreign Application Priority Data

Sep. 6, 2017 (JP) ..... 2017-171550

(51) Int. Cl.
*B41J 2/16* (2006.01)

(52) U.S. Cl.
CPC ..... *B41J 2/1628* (2013.01); *B41J 2/162* (2013.01); *B41J 2/1603* (2013.01); *B41J 2/1629* (2013.01); *B41J 2/1631* (2013.01); *B41J 2/1632* (2013.01); *B41J 2/1635* (2013.01); *B41J 2/1642* (2013.01)

(58) Field of Classification Search
CPC ..... B41J 2/1628; B41J 2/1642; B41J 2/1603; B41J 2/1632; B41J 2/1631; B41J 2/1629; B41J 2/1635; B41J 2/162
See application file for complete search history.

(56) References Cited

U.S. PATENT DOCUMENTS

| | | | | |
|---|---|---|---|---|
| 7,531,047 | B1 * | 5/2009 | Dryer | B41J 2/1603 134/1.1 |
| 8,083,324 | B2 | 12/2011 | Kwon et al. | |
| 9,216,570 | B2 | 12/2015 | Matsumoto et al. | |
| 9,789,690 | B2 | 10/2017 | Watanabe et al. | |
| 2014/0363907 | A1 * | 12/2014 | Sakai | B41J 2/1603 438/21 |
| 2015/0068036 | A1 * | 3/2015 | Yaginuma | B41J 2/1628 29/890.1 |

OTHER PUBLICATIONS

Wang et al. (Characterization of Surface Properties of Plasma—Polymerized Fluorinated Hydrocarbon Layers: Surface Stability as a Requirement for Permanent Water Repellency, Journal of Applied Polymer Science, vol. 49, 701-710 (1993), pages (Year: 1993).*

* cited by examiner

*Primary Examiner* — Nadine G Norton
*Assistant Examiner* — Mahmoud Dahimene
(74) *Attorney, Agent, or Firm* — Venable LLP

(57) ABSTRACT

To manufacture a liquid ejection head, a film having a lower surface free energy than a surface free energy of a substrate is first formed on an inner face of a liquid supply port. Next, a dry film to be a flow path forming member is attached to cover the surface of the substrate, and then a member to be an ejection orifice forming member is provided on the surface of the dry film.

7 Claims, 4 Drawing Sheets

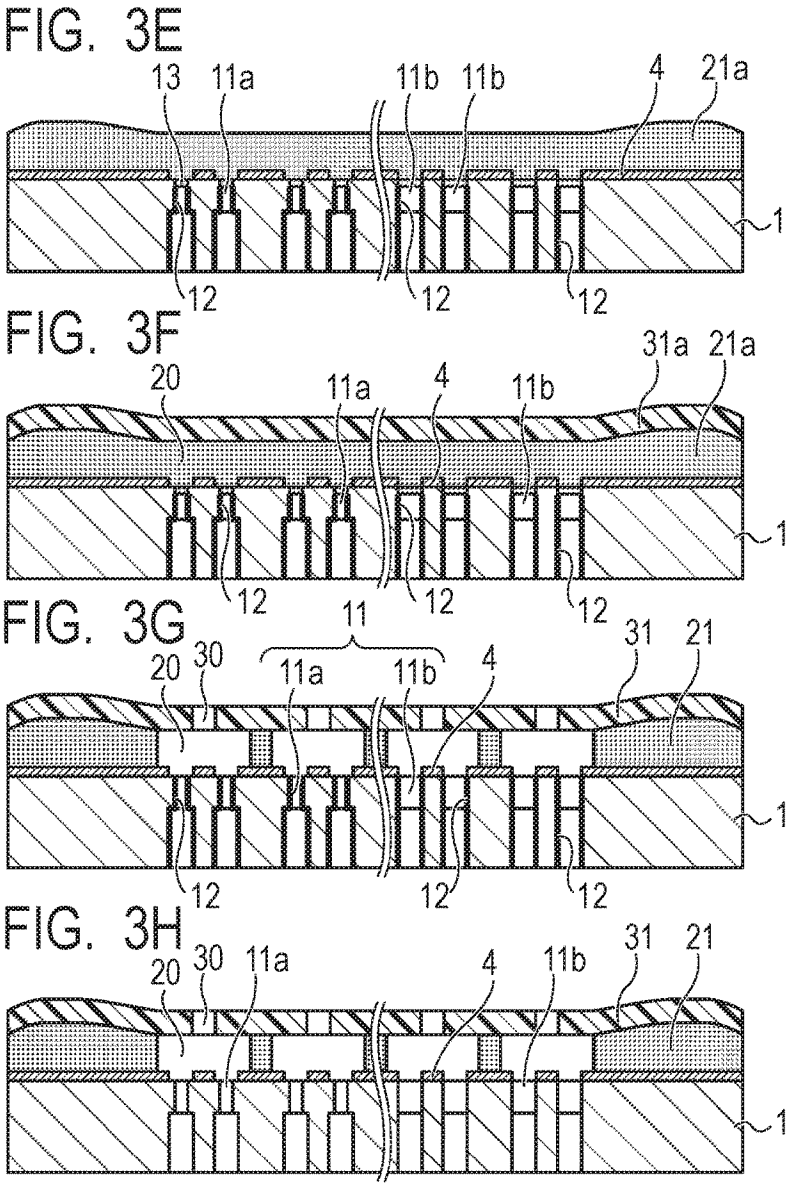
FIG. 3E
FIG. 3F
FIG. 3G
FIG. 3H
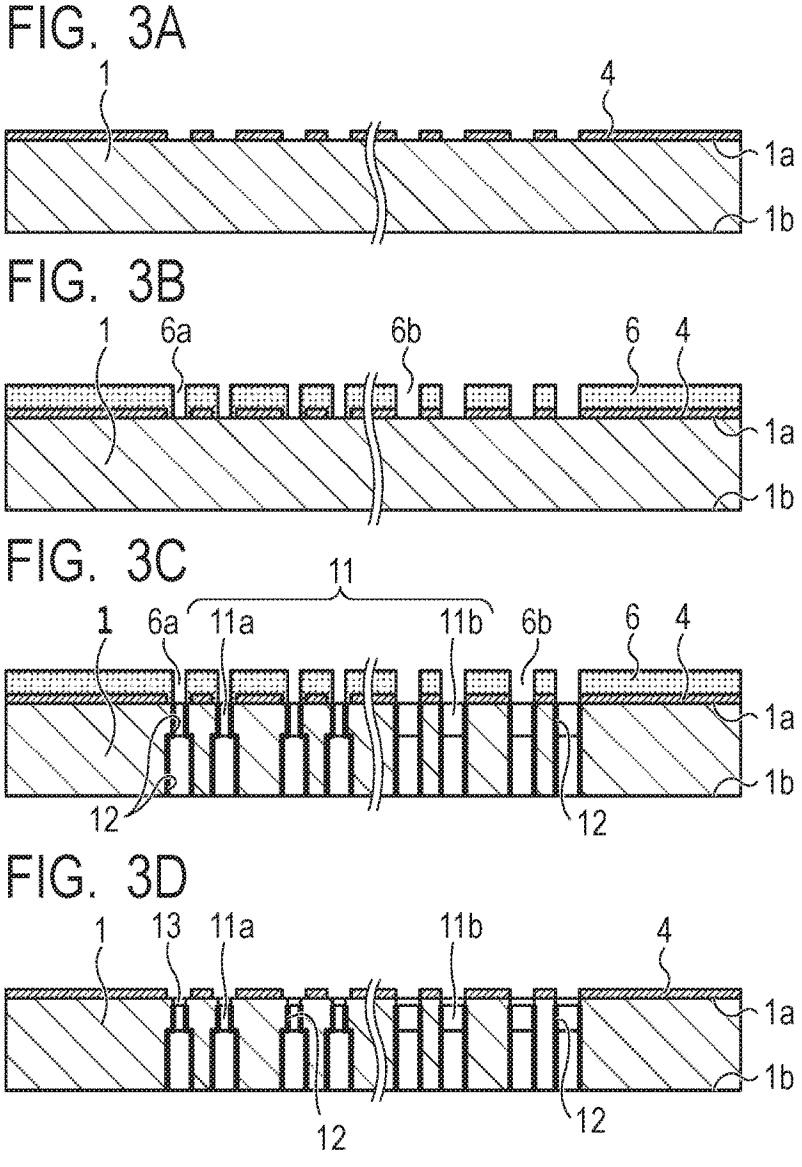
FIG. 3A
FIG. 3B
FIG. 3C
FIG. 3D

METHOD OF MANUFACTURING LIQUID EJECTION HEAD AND METHOD OF MANUFACTURING STRUCTURE

BACKGROUND OF THE INVENTION

Field of the Invention

The present disclosure relates to a method of manufacturing a liquid ejection head that ejects a liquid and a method of manufacturing a structure.

Description of the Related Art

U.S. Pat. No. 8,083,324 discloses a method of manufacturing a liquid ejection head in which a dry film is formed on a substrate to manufacture a liquid ejection head. In the manufacturing method, onto the surface of a substrate with through-holes such as liquid supply ports, a dry film is attached to form a flow path forming member, and then an ejection orifice forming member is formed on the flow path forming member. Subsequently, the flow path forming member and the ejection orifice forming member are subjected to microfabrication using photolithographic technique, and a liquid ejection head having a structure containing ejection orifices, flow paths, and the like is manufactured.

As disclosed in U.S. Pat. No. 8,083,324, when a dry film is provided on the surface of a substrate to form a microscopic structure such as a flow path forming member, the dry film is required to be in close contact with the substrate without gaps as much as possible. To achieve this, a dry film is typically attached to a substrate while heated and pressed. This process enables attachment of a dry film without clearance while filling level differences formed on a substrate or the like.

However, when a substrate has through-holes (liquid supply ports), a dry film softened by heating or the like may flow into the through-holes to impair the surface flatness of a structure. In particular, when a substrate has through-holes having different opening areas, a dry film largely flows around through-holes having small opening areas, and this can reduce the surface flatness. For example, in the manufacturing of a liquid ejection head, when a flow path forming member formed from a dry film fails to maintain surface flatness, an ejection orifice forming member formed thereon also fails to have surface flatness. As a result, ejection orifices formed on the ejection orifice forming member have uneven heights, and the ejection performance of the ejection orifices varies.

SUMMARY OF THE INVENTION

An aspect of the present disclosure is a method of manufacturing a liquid ejection head that includes a substrate having formed a liquid supply port as a through-hole, an ejection orifice forming member having formed an ejection orifice configured to eject a liquid, and a flow path forming member for forming a flow path that communicates with the liquid supply port and the ejection orifice, on a surface of the substrate, and the method includes a step of forming, on an inner face of the liquid supply port, a film having a lower surface free energy than a surface free energy of the substrate, a step of attaching a dry film to be the flow path forming member so as to cover the surface of the substrate having the liquid supply port provided with the film, and a step of providing, on an opposite face of the dry film to the face facing the surface of the substrate, a member to be the ejection orifice forming member.

Another aspect of the present disclosure is a method of manufacturing a structure on a substrate having a through-hole using a dry film, and the method includes, before attaching the dry film to the substrate, providing, on an inner face of the through-hole, a film having a lower surface free energy than a surface free energy of the substrate.

Further features of the present disclosure will become apparent from the following description of exemplary embodiments with reference to the attached drawings.

BRIEF DESCRIPTION OF THE DRAWINGS

FIGS. 3A, 3B, 3C, 3D, 3E, 3F, 3G and 3H are schematic cross-sectional views showing principal manufacturing steps of the liquid ejection head shown in FIG. 2.

DESCRIPTION OF THE EMBODIMENTS

Preferred embodiments of the present disclosure will now be described in detail in accordance with the accompanying drawings.

The present disclosure is intended to provide a method of manufacturing a liquid ejection head in which a dry film is attached on the surface of a substrate having through-holes, so as to achieve satisfactory performances.

Embodiments of the present disclosure will now be described with reference to drawings. In the present embodiment, a method of manufacturing a liquid ejection head to be installed on a liquid ejection apparatus such as an ink jet recording apparatus will be described as an example.

Figure 1:
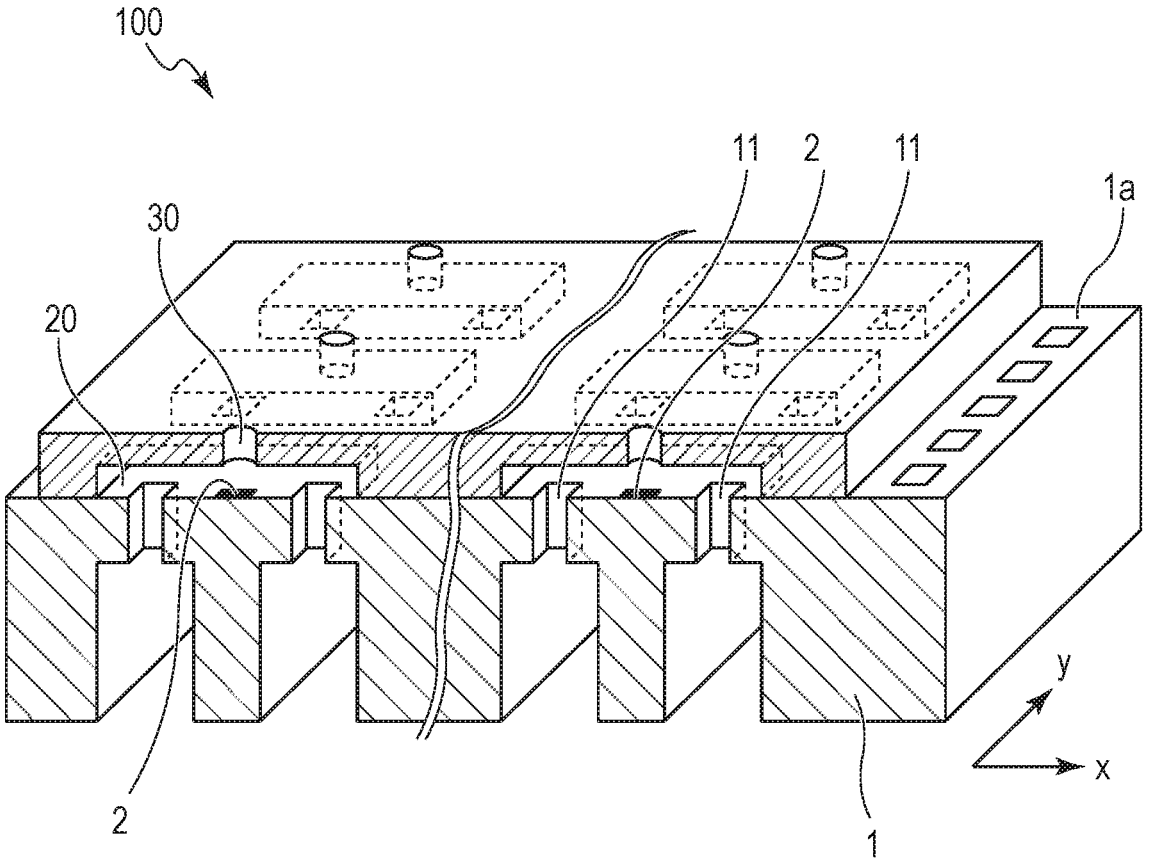
FIG. 1 is a cross-sectional perspective view schematically showing an example of a liquid ejection head of the present disclosure.
Figure 2:
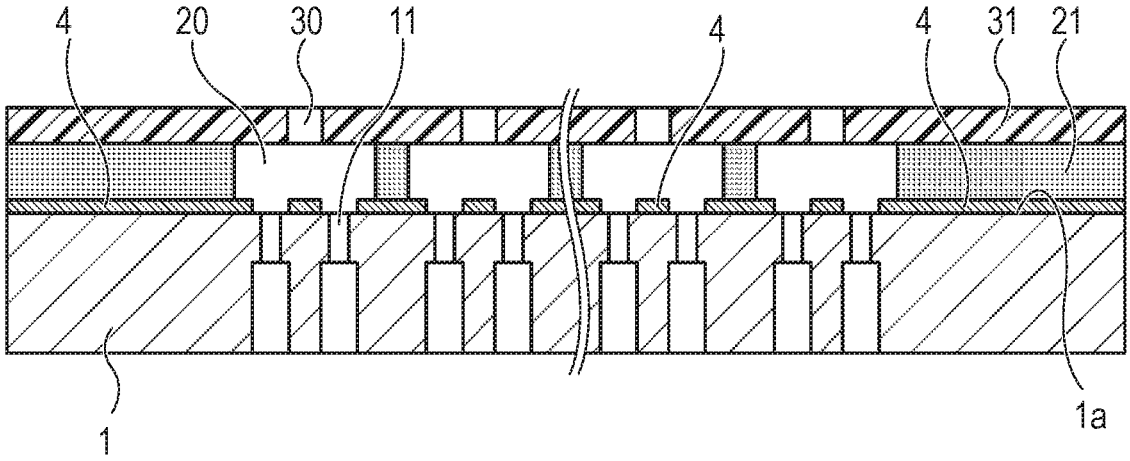
FIG. 2 is a schematic cross-sectional view of the liquid ejection head shown in FIG. 1.

FIG. 1 is a cross-sectional perspective view schematically showing an example of the liquid ejection head in the embodiment, and FIG. 2 is a schematic cross-sectional view of the liquid ejection head shown in FIG. 1. The liquid ejection head 100 shown in FIG. 1 and FIG. 2 includes a silicon substrate 1 (hereinafter, simply referred to as "substrate 1") on which a plurality of ejection energy generating elements 2 are arranged in y-direction at a predetermined pitch. On a top face 1*a* of the substrate 1 or a face with the ejection energy generating elements 2 (in FIG. 2, the upper face) 1*a*, an insulating layer (not shown) and an adhesion layer 4 (see FIG. 2) are formed. On the adhesion layer 4, a flow path forming member 21 is provided. On the surface of the flow path forming member 21 (the upper face in FIG. 2), an ejection orifice forming member 31 is provided.

In the liquid ejection head 100 in the embodiment, the ejection orifice forming member 31, the flow path forming member 21, and the substrate 1 define flow paths 20. In other words, the flow path forming member 21 defines the side wall of the flow paths 20, and the ejection orifice forming member 31 defines the ceiling of the flow paths. In the ejection orifice forming member 31, ejection orifices 30 for ejecting a liquid are formed at positions facing the ejection energy generating elements 2 (see FIG. 1). A plurality of the ejection energy generating elements are arranged in y-direction in FIG. 1 to form element arrays. FIG. 2 shows no ejection energy generating elements but shows the adhesion layer 4.

In the substrate 1, liquid supply ports (through-holes) 11 penetrating from the top face (first face) to the bottom face (second face) are adjacently formed on the respective sides of each ejection energy generating element 2. A pair of adjacent liquid supply ports 11 communicate with a flow path 20. The above described insulating protective film (not shown) and the adhesion layer 4 are patterned corresponding to the openings of the liquid supply ports 11 by photolithography, dry etching, or the like, and the liquid supply ports 11 communicate with the flow paths 20 and the ejection orifices 30.

In the liquid ejection head having the above structure, a liquid supplied from a liquid supply source such as a liquid storage tank (not shown) is supplied through liquid supply ports 11*a*, 11*b* to the flow paths 20 and then is supplied to the ejection orifices 30. Subsequently, an ejection energy generating element 2 applies a pressure to the liquid in a flow path 20, a liquid drop is ejected from an ejection orifice 30. Such liquid drops adhere to a recording medium to form an image.

Next, a method of manufacturing a liquid ejection head in the embodiment will be described.

FIGS. 3A to 3H are schematic cross-sectional views showing principal manufacturing steps of a liquid ejection head. On a substrate 1 shown in FIG. 3A, a plurality of ejection energy generating elements (not shown in FIG. 3A) are arranged, and an insulating protective film (not shown in FIG. 3A) is formed thereon. On the insulating protective film, an adhesion layer 4 is pattern-formed. The patterning of the adhesion layer 4 may be performed by photolithography process, or the adhesion layer 4 on which a mask is formed may be subjected to dry etching. The material of the adhesion layer 4 is preferably a material that can achieve adhesion between the insulating protective film and the flow path forming member 21 described later and is stable to a liquid that is to be filled, such as a polyether amide resin and an epoxy resin.

The substrate 1 can be made from a material usable as a semiconductor device substrate, such as silicon. The material of the liquid ejection energy generating element may be any resistive component, such as TaSiN (tantalum-silicon-nitride), capable of heating a liquid and applying ejection energy to the liquid in response to electric signals. As the material of the insulating protective film, for example, SiN (silicon nitride), SiC (silicon carbide), or SiO (silicon oxide) can be used, but the material is not limited to them, and any material capable of protecting electric wiring against inks or other liquids can be used.

Next, as shown in FIG. 3B, a mask resist 6 for forming liquid supply ports is patterned on the adhesion layer 4. As shown in FIG. 3C, in the silicon substrate 1, through-holes penetrating from the top face (first face) 1*a* to the bottom face (second face) 1*b* are formed as liquid supply ports 11 by dry etching. In the present embodiment, as the liquid supply ports 11, liquid supply ports 11*a* and liquid supply ports 11*b* having different opening areas are formed in the substrate 1. The liquid supply ports 11*a* are through-holes having a smaller opening area than that of the liquid supply ports 11*b*. The dry etching for forming the liquid supply ports is preferably performed by Bosch process. Accordingly, on the processed face (inner face) of the liquid supply ports 11*b*, a deposited film 12 including a CF polymer (fluorocarbon polymer) is formed. The deposited film is a film formed by deposition of a reaction product on the resist surface and the surface of a substrate (including etched side faces) during dry etching including Bosch process.

The insulating protective film formed on the substrate 1 may be previously patterned corresponding to the openings of the liquid supply ports 11 or may be patterned simultaneously with the formation of the liquid supply ports 11. In the present embodiment, patterning of the adhesion layer 4 is followed by formation of the liquid supply ports 11, but the order of the forming steps is not particularly limited.

Next, as shown in FIG. 3D, the mask resist 6 is removed. The mask resist 6 may be removed by wet etching or by dry etching having a certain selection ratio to the substrate. Concurrently with the removal of the mask resist 6, a part of the deposited film 12 formed in the liquid supply ports 11, located on the surface side of the substrate 1 (ejection energy generating element formation face) is removed. This removal is preferred to achieve appropriate coating treatment of level differences on the substrate 1 in the subsequent step.

As shown in FIG. 3E, a dry film 21*a* to be a flow path forming member 21 is attached (transferred) onto the surface of the adhesion layer 4 so as to cover the top face 1*a* of the substrate 1. This transfer is performed by heating and pressing the dry film 21*a* with a heat roller or the like. The dry film 21*a* thus covers level differences formed between the adhesion layer 4 and the top face 1*a* of the substrate 1, and the dry film 21*a* slightly flows into the liquid supply ports 11. This is an inflow of the dry film 21*a* softened by heating, onto a silicon exposed portion 13 formed by removal of the deposited film 12 in the preceding step. Accordingly, the level differences between the adhesion layer 4 and the substrate 1 are filled with the dry film 21*a*, and the dry film 21*a* covers the adhesion layer 4 and the substrate without clearance. If level differences of the adhesion layer 4 are not covered, isolated spaces are formed between the adhesion layer 4 and the dry film 21*a*. The spaces can cause irregular light reflection or the like in an exposure step performed later to generate abnormal patterns, or can expand the air in the isolated spaces to deform ejection orifices. Hence, less space is preferred.

The dry film 21*a* is preferably a photosensitive resin, and the photosensitive resin is preferably fixed to a support member when transferred. The support member of the dry film 21*a* may be any material stable to heat histories of a flow path forming member, such as polyethylene terephthalate and polyimide. The photosensitive resin used as the dry film 21*a* is preferably a negative photosensitive resin. Examples of the negative photosensitive resin include cyclic polyisoprenes containing a bisazide compound, cresol novolac resins containing azidopyrene, and epoxy resins containing a diazonium salt or an onium salt.

The dry film 21*a* after transfer to the substrate 1 has a smaller film thickness than the film thickness of the dry film 21*a* before transfer. This is because the dry film 21*a* is heated and pressed to be deformed as described above at the time of transfer and the deformed volume of the dry film flows into the liquid supply ports 11. The temperature and the pressure applied at the time of transfer are preferably within such ranges that the dry film 21*a* can be softened to cover the adhesion layer 4 while filling level differences of the adhesion layer and the resin does not excessively degenerate. For example, the temperature is preferably 60° C. or more to 140° C. or less, and the pressure is preferably 0.1 MPa or more to 1.5 MPa or less.

After transfer of the dry film 21*a* onto the substrate 1 by heat and pressure, the support member is released from the dry film 21*a*, and the dry film 21*a* is allowed to stay on the substrate 1. In the present embodiment, the dry film 21*a* left on the substrate 1 is formed to have a substantially uniform thickness as shown in FIG. 3E, and satisfactory surface flatness is achieved. This is because the dry film 21*a* at the time of heating and pressing is prevented from flowing into the liquid supply ports 11 by the deposited film 12 having a lower surface free energy than that of the substrate. In other words, the position to which the dry film 21*a* flows into the liquid supply ports 11 can be controlled by the portion from which the deposited film 12 is removed (silicon exposed portion 13). Hence, even when a substrate 1 has liquid supply ports 11 having different opening areas (11*a* and 11*b* in the embodiment), the amount of the dry film 21*a* flowing into the respective liquid supply ports does not greatly vary. Accordingly, the dry film 21*a* to be a flow path forming member does not have uneven surface flatness, which would have be caused by differences in the amount flowing into liquid supply ports, and satisfactory surface flatness is achieved.

Subsequently, regions in the dry film 21*a* intended to be left as the side wall portions of flow paths are selectively exposed through a photomask (not shown), and post exposure bake (hereinafter, also referred to "PEB") is performed to optically determine cured regions and uncured regions. In the present embodiment, a negative photosensitive resin is used as the dry film 21*a*, thus an exposed region is a cured region, and an unexposed region is an uncured region. The cured regions correspond to the side wall portions of flow paths 20, and the uncured regions correspond to flow paths 20.

Next, as shown in FIG. 3F, on the surface of the dry film 21*a* or on the oppose face of the dry film 21*a* to the face facing the top face 1*a* of the substrate 1, a member 31*a* to be an ejection orifice forming member 31 is formed. The member 31*a* to be an ejection orifice forming member may be formed by any method. In the present embodiment, the member 31*a* to be an ejection orifice forming member is formed by transfer of a dry film. Using a dry film as the member 31*a* to be an ejection orifice forming member is preferred from the viewpoint of sensitivity separation between the dry film 21*a* and the member 31*a* to be an ejection orifice forming member. The material of the member 31*a* to be an ejection orifice forming member is preferably a negative photosensitive resin. Examples of the negative photosensitive resin used as the member 31*a* to be an ejection orifice forming member include cyclic polyisoprenes containing a bisazide compound, cresol novolac resins containing azidopyrene, and epoxy resins containing a diazonium salt or an onium salt.

The temperature and the pressure of the member 31*a* to be an ejection orifice forming member at the time of transfer are preferably set in such ranges that the member 31*a* to be an ejection orifice forming member can be transferred onto the dry film 21*a* and the previously formed dry film 21*a* does not deform. For example, the member 31*a* to be an ejection orifice forming member is preferably formed at a temperature of 30° C. or more to 50° C. or less and at a pressure of 0.1 MPa or more to 0.5 MPa or less.

Next, regions in the member 31*a* to be an ejection orifice forming member, intended to be left as the periphery of the ejection orifices are selectively exposed through a photomask (not shown), and post exposure bake (PEB) is performed to optically determine cured regions and uncured regions. In the present embodiment, a negative photosensitive resin is used, thus an exposed region is a cured region, and the cured region forms an ejection orifice-forming region and a flow path ceiling. The material of the member 31*a* to be an ejection orifice forming member preferably has a higher sensitivity than that of the dry film 21*a*. Specifically, the member 31*a* to be an ejection orifice forming member preferably contains a larger amount of a photo-acid generator, and the dry film 21*a* preferably contains a smaller amount of a photo-acid generator. In such a condition, exposure can generate acid in the member 311*a* to be an ejection orifice forming member but generate no acid in the dry film 21*a*, and thus the member 31*a* to be an ejection orifice forming member can be selectively patterned. Before the exposure step of the member 31*a* to be the ejection orifice forming member, a liquid repellent film may be formed on the surface of the member 31*a* to be an ejection orifice forming member, and then exposure may be performed. In the exposure step in such a case, the unexposed regions of the dry film 21*a* hardly undergo curing reaction.

Subsequently, as shown in FIG. 3G, a liquid capable of dissolving the unexposed regions of the dry film 21*a* and the member 31*a* to be an ejection orifice forming member is used to dissolve and remove the unexposed regions, and the pattern is developed. In the development, the dry film 21*a* and the member 31*a* to be an ejection orifice forming member are preferably, simultaneously developed. Here, "simultaneous development" means that a single type of solvent is used to develop all the layers by a single treatment. By removing the unexposed regions with a dissolvable solvent in the step, flow paths 20 are formed in the dry film 21*a*, and the dry film 21*a* becomes a flow path forming member 21. Ejection orifices 30 are also formed in the member 31*a* to be an ejection orifice forming member, and the member 31*a* to be an ejection orifice forming member becomes an ejection orifice forming member 31. In the step, the deposited film 12 is not dissolved and is left in the liquid supply ports 11*a*, 11*b*. Next, as shown in FIG. 3H, the left deposited film 12 is removed. To remove the deposited film 12, a removal liquid not affecting the flow path forming member 21 and the ejection orifice forming member 31 is preferably used.

Through the steps, a substrate for a liquid ejection head is completed. The substrate for a liquid ejection head is cut and separated by a dicing saw or the like, giving chips. To each chip, electric wirings for driving ejection energy generating elements 2 are connected, and then a chip tank member for supplying a liquid is connected. Consequently, a liquid ejection head is completed.

According to the manufacturing method of the embodiment, a flow path forming member formed on a substrate obtains a uniform thickness to achieve satisfactory surface flatness, and an ejection orifice forming member formed on the flow path forming member also obtains satisfactory surface flatness. Hence, the heights of flow paths and ejection orifices and the diameter of ejection orifices can be formed in accordance with intended design standards, and the manufactured liquid ejection head obtains ejection performances without variation.

In the embodiment, a part of the deposited film located on the element formation face side is removed concurrently with the removal of the mask resist, and thus level differences formed on the substrate (level differences from the adhesion layer) can be more appropriately filled when the flow path forming member as a dry film is formed on the substrate. Hence, spaces between the substrate and the adhesion layer and the flow path forming member can be prevented from generating.

The deposited film formed on the inner face of the liquid supply ports may be any other film than the CF polymer as long as the film has a lower surface free energy than that of the substrate (in the embodiment, a silicon substrate). Even when a substrate has a plurality of liquid supply ports all having the same opening area, the amount of the flow path forming member flowing into the liquid supply ports can be suppressed in the present embodiment, thus the surface flatness of the flow path forming member and the ejection orifice forming member can be maintained, and the embodiment is effective.

In the present embodiment, a part of the deposited film in the liquid supply ports located on the element formation face side is removed to form a silicon exposed portion 13 at the time of mask resist removal for processing liquid supply ports. However, a part of the deposited film in the liquid supply ports is not necessarily removed, and the deposited film may be left, when level differences have no effect or have negligible effects. Although liquid supply ports having different opening areas can be arranged in various positional patterns, the present disclosure is effective in any positional pattern.

Another Embodiment

The above embodiment has described a method of manufacturing a liquid ejection head that includes a substrate having liquid supply ports as through-holes, an ejection orifice forming member having ejection orifices configured to eject a liquid, and a flow path forming member for defining flow paths communicating the liquid supply ports and the ejection orifices. The present disclosure is also applicable to manufacturing of a structure that includes a substrate having through-holes and a dry film attached to the surface of the substrate. In other words, such a characteristic technique as forming, on the inner face of through-holes formed in a substrate, a film having a lower surface free energy than that of the substrate, before attachment of a dry film to the surface of the substrate is also applicable to methods for manufacturing other structures, in addition to the above liquid ejection head. According to the characteristic technique, when a heated and pressed dry film is attached to the surface of a substrate, the softened dry film is unlikely to flow onto the inner face of through-holes. Hence, the thickness of a film formed from a dry film can be more precisely controlled, and a structure having uniform performance can be manufactured in accordance with design standards.

EXAMPLES

Example 1

An example of the present disclosure will next be described in further detail with reference to drawings.

As shown in FIG. 1, a plurality of ejection energy generating elements 2 for generating liquid ejection energy were arranged on a substrate 1, and then an insulating protective film (not shown) was formed thereon. On the insulating protective film, an adhesion layer of a polyether amide resin was then formed, and the insulating protective film and the adhesion layer 4 were patterned (see FIG. 2, FIG. 3A). The patterning of the insulating protective film and the adhesion layer 4 was performed as follows: on the adhesion layer 4, a mask resist was patterned, and the mask resist was used to perform dry etching. The mask resist was then removed. The adhesion layer 4 was formed to have a thickness of 2 μm. This patterning was previously performed at positions where through-holes (liquid supply ports) 11 were to be formed in a later step. The substrate 1 used was a silicon substrate, and the heat generating resistive material used was TaSiN. The insulating protective film was formed by plasma CVD with SiO and SiN.

As shown in FIG. 3B, a mask resist 6 was next formed on the adhesion layer 4, and the mask resist 6 was patterned. The pattern formed on the mask resist 6 corresponded to liquid supply ports 11*a*, 11*b* to be formed in the substrate 1 in the later etching step. In other words, opening parts 6*a* of the mask resist 6 were formed at positions in a size (opening area) corresponding to the liquid supply ports 11*a*, and opening parts 6*b* were formed at positions in a size (opening area) corresponding to the liquid supply ports 11*b*. The opening parts 6*a* were formed to have a smaller opening area than the opening area of the opening parts 6*b*.

Next, Bosch process was performed as shown in FIG. 3C to form through-holes as liquid supply ports 11 penetrating through the silicon substrate 1 and the insulating protective film formed thereon (not shown). As mentioned above, the opening area of each opening part 6*a* of the mask resist 6 was smaller than the opening area of each opening part 6*b*. Accordingly, liquid supply ports 11*a* having a relatively small opening area corresponding to the mask resist 6*a* and liquid supply ports 11*b* having a relatively large opening area corresponding to the mask resist 6*b* were formed in the silicon substrate 1. On the inner wall of the liquid supply ports 11, a deposited film 12 including a CF polymer was formed by the Bosch process.

As shown in FIG. 3D, the mask resist 6 and a part of (upper end part) of the deposited film 12 were next removed by dry etching to form silicon exposed portions 13.

As shown in FIG. 3E, a dry film 21*a* was next formed on the insulating protective film (not shown) and the adhesion layer 4. The dry film 21*a* used was a negative photosensitive resin fixed on a support member. The dry film 21*a* had a thickness of 14 m on the ejection energy generating elements. The transfer apparatus used was VTM-200 (trade name, manufactured by Takatori Corporation).

The negative photosensitive resin used was a mixture of 100 parts by mass of EHPE 3150 (trade name, manufactured by Daicel, an epoxy resin), 6 parts by mass of a cationic photopolymerization catalyst, SP-172 (trade name, manufactured by ADEKA), and 20 parts by mass of a binder resin, jER 1007 (trade name, manufactured by Mitsubishi Chemical Corporation). The support member of the dry film 21*a* used was a release treated PET film. For transfer of the dry film 21*a*, the temperature was 70° C., and the pressure was 0.5 MPa. The release rate of the support member was 5 mm/s.

As a result of the transfer of the dry film 21*a* onto the substrate 1 in such conditions as above, the amount of the dry film 21*a* flowing into the liquid supply ports 11*a* having a small opening area was reduced as compared with conventional methods, and the dry film 21*a* obtained satisfactory surface flatness.

Next, regions in the dry film 21*a* to give flow path side walls were exposed to i-line (wavelength: 365 nm) using FPA-3000i5+(manufactured by Canon) through a photomask, and then PEB was performed. The exposure amount was 8,000 J/m$^2$. The PEB was performed by heating on a hot plate at 50° C. for 4 minutes to facilitate curing reaction.

Next, as shown in FIG. 3F, on the dry film 21*a*, a member 31*a* that was made from a dry film including a negative photosensitive resin and was to be an ejection orifice forming member was next formed in a thickness of 10 μm. The negative photosensitive resin used was a mixture of 100 parts by mass of EHPE 3150 (trade name, manufactured by Daicel, an epoxy resin) and 3 parts by mass of a cationic photopolymerization initiator onium salt. Here, the onium salt used had higher photosensitivity than that of the cationic photopolymerization catalyst, SP-172 used for the dry film 21*a*, and was capable of generating cations even at a low exposure amount. The support member for the dry film used as the member 31*a* to be an ejection orifice forming member was a release treated PET film. The member 31*a* to be an ejection orifice forming member was transferred at a temperature of 40° C. and a pressure of 0.3 MPa. The support member was released at a release rate of 5 mm/s.

Next, regions to be flow path ceilings in the member 31*a* to be an ejection orifice forming member were exposed to i-line (wavelength: 365 nm) using FPA-3000i5+(manufactured by Canon) to optically determine cured regions to be flow path ceilings and uncured regions to be ejection orifices. The exposure amount was 1,000 J/m$^2$. Exposure to the member 31*a* to be an ejection orifice forming member allowed light to pass through the member 31*a* to be an ejection orifice forming member, and the light was also applied to the previously formed, unexposed regions of the dry film 21*a*. However, the member 31*a* to be an ejection orifice forming member was adjusted to have a lower photosensitivity than the photosensitivity of the dry film 21*a*, and thus exposure to the member 311*a* to be an ejection orifice forming member caused no curing reaction of the dry film 21*a*. PEB was subsequently performed by heating on a hot plate at 90° C. for 5 minutes to facilitate curing reaction.

Next, the uncured regions of the dry film 21*a* and the member 31*a* to be an ejection orifice forming member were simultaneously developed and removed to form flow paths 20 and ejection orifices 30, thus the dry film 21*a* became a flow path forming member 21, and the member 31*a* to be an ejection orifice forming member became an ejection orifice forming member 31. Propylene glycol monomethyl acetate was used as the solvent for dissolving the unexposed regions, and development treatment was performed for 15 minutes. The deposited film 12 was not dissolved but was left.

Next, as shown in FIG. 3G, a hydrofluoroether (HFE) was used to remove the deposited film 12. During the removal, the previously formed flow path forming member 21, the ejection orifice forming member 31, and the adhesion layer 4 were not changed, and intended flow paths 20, ejection orifices 30, and liquid supply ports 11 (11*a*, 11*b*) were formed.

Through the above steps, a substrate for a liquid ejection head was completed. The substrate for a liquid ejection head was cut and separated by a dicing saw or the like to give chips. To each chip, electric wirings for driving liquid ejection energy generating elements were connected, and then a chip tank member for supplying a liquid was connected. Consequently, a recording head in which the flow paths having an intended height were uniformly formed and the ejection orifices 30 had a uniform height was completed. When the recording head was used to record images, the formed images had satisfactory quality, and this indicated that each ejection orifice had uniform ejection performance.

Comparative Example

As a comparative example to the above example, a conventional method of manufacturing a liquid ejection head will be described. The comparative example includes the following procedure, unlike the above example: a deposited film in liquid supply ports formed when liquid supply ports are formed is removed, and then a flow path forming member is transferred onto the substrate. The procedure will be specifically described hereinafter.

Figure 4A:
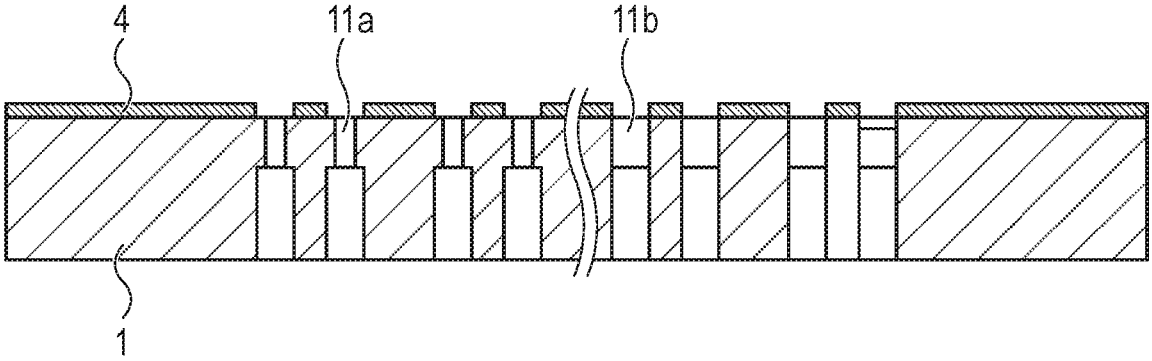
FIGS. 4A, 4B and 4C are schematic cross-sectional views showing a conventional method of manufacturing a liquid ejection head.
Figure 4B:
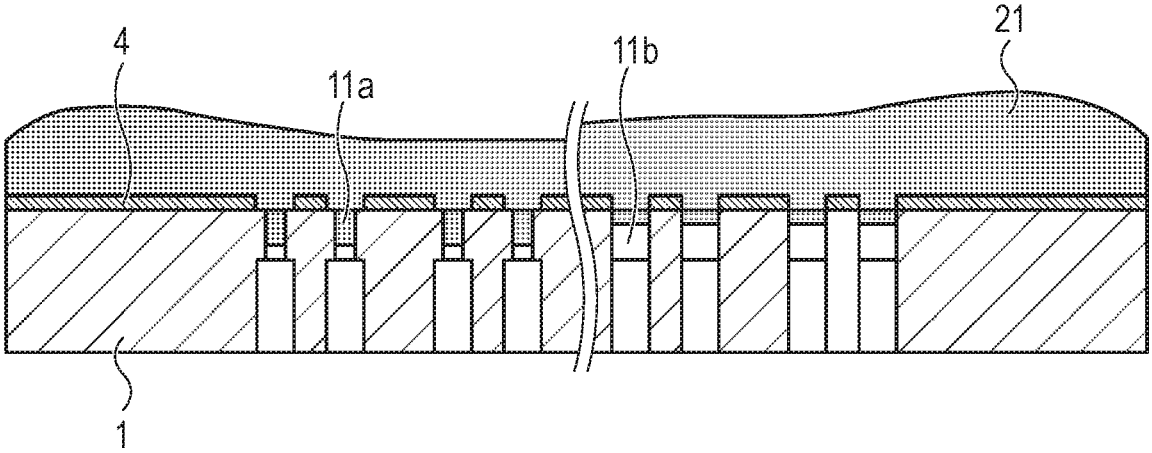
Figure 4C:
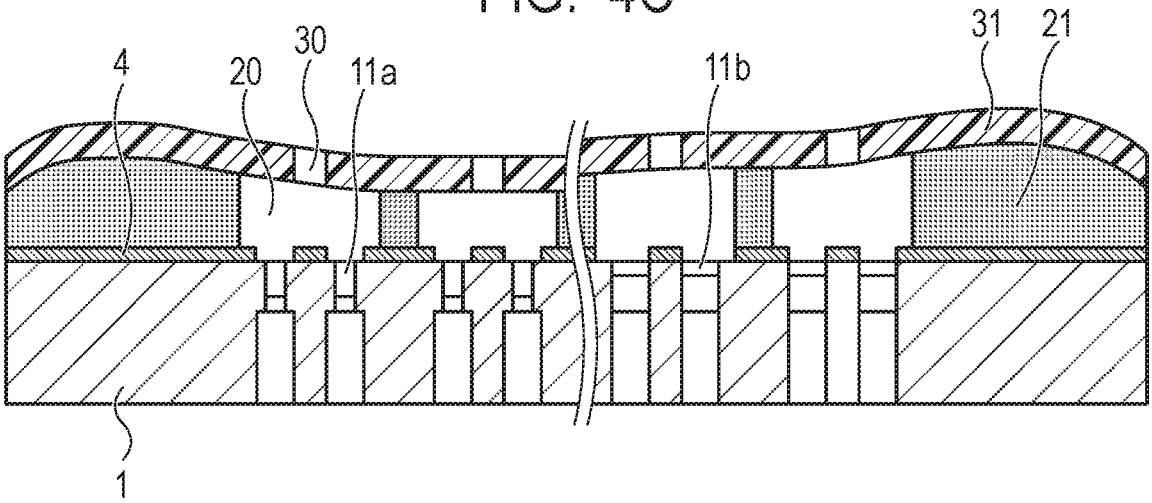

FIGS. 4A to 4C are schematic cross-sectional views showing a method of manufacturing a liquid ejection head in Comparative Example. As shown in FIG. 4A, liquid supply ports 11*a*, 11*b* having different opening areas and an adhesion layer 4 having a pattern corresponding thereto were formed on a substrate 1. The liquid supply ports 11*a*, 11*b* were formed by Bosch process. In Comparative Example, the liquid supply ports 11*a*, 11*b* were formed, and then the deposited film formed in the liquid supply ports 11*a*, 11*b* was removed before formation of a flow path forming member.

As shown in FIG. 4B, a dry film 21*a* was next transferred by heating and pressing onto an insulating protective film (not shown) and the adhesion layer 4, in the same manner as in Example 1. The dry film 21*a* softened by heating flowed into both the liquid supply ports 11*a*, 11*b*. The amount of the flow path forming member flowing into each of the liquid supply ports 11*a*, 11*b* was larger than the amount in the example. The amount of the dry film 21*a* flowing into the liquid supply ports 11*a* having a small opening area was larger than the amount of the dry film flowing into the liquid supply ports 11*b* having a large opening area. Hence, the thickness around the liquid supply ports 11*a* was smaller than the thickness around the liquid supply ports 11*b*, and the dry film 21*a* had lower flat surface flatness as compared with the example.

Next, a member 31*a* to be an ejection orifice forming member was formed on the dry film 21*a*, and regions intended to be left as the periphery of ejection orifices were exposed. The material and the exposure amount were the same as in Example 1. PEB was subsequently performed to facilitate curing, then as shown in FIG. 4C, concurrent development was performed to form flow paths 20 and ejection orifices 30, thus the dry film 21*a* became a flow path forming member 21, and the member 31*a* to be an ejection orifice forming member became an ejection orifice forming member 31. Through the process, a liquid ejection head having the flow paths 20 and the ejection orifices 30 was completed.

The liquid ejection head of Comparative Example manufactured in accordance with the above procedure was used to record images on recording media. As a result, deflection was caused at an impact position (recorded position) of liquid drops ejected from an ejection orifice located at an end. Observation of the liquid ejection head revealed that dimensions including the diameters of the ejection orifices and the heights of the flow paths and the ejection orifices were out of design standards.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-171550, filed Sep. 6, 2017, which is hereby incorporated by reference herein in its entirety.

What is claimed is:

1. A method of manufacturing a liquid ejection head, the liquid ejection head including a substrate having formed a liquid supply port as a through-hole, an ejection orifice forming member having formed an ejection orifice configured to eject a liquid, and a flow path forming member for forming a flow path that communicates with the liquid supply port and the ejection orifice, on a surface of the substrate, the method comprising:

a step of forming, on an inner face of the liquid supply port, a film having a lower surface free energy than a surface free energy of the substrate;

a step of attaching a dry film to be the flow path forming member to the surface of the substrate; and a step of providing, on a second face of the dry film that is opposite to a first face of the dry film, the first face facing the surface of the substrate, a member to be the ejection orifice forming member, wherein the dry film is made of a different material than the member to be the ejection orifice forming member, and wherein in the step of attaching the dry film, the inner face of the liquid supply port is entirely covered by the film.

2. The method according to claim 1, wherein the substrate is silicon, and the film is a deposited film formed when dry etching is performed to form the liquid supply port.

3. The method according to claim 2, wherein a part of the film located on a surface side of the substrate is removed.

4. The method according to claim 3, wherein the liquid supply port is formed by etching using a mask resist provided on the surface of the substrate, and wherein, the part of the film located on the surface side of the substrate is removed by etching used to remove the mask resist.

5. The method according to claim 1, wherein the liquid supply port is formed by a Bosch process.

6. The method according to claim 1, further comprising a step of forming the ejection orifice in the member to be the ejection orifice forming member, wherein after the forming of the ejection orifice in the member to be the ejection orifice forming member, the film formed on the inner face of the liquid supply port is removed.

7. The method according to claim 6, wherein the film is removed using a hydrofluoroether.

* * * * *